United States Patent [19]

Rosser et al.

[11] 4,397,907

[45] Aug. 9, 1983

[54] MULTI-PURPOSE AIR PERMEABLE COMPOSITES

[75] Inventors: Robin W. Rosser, Santa Monica; Leon B. Keller, Palos Verdes Estates, both of Calif.

[73] Assignee: Hughes Aircraft Company, El Segundo, Calif.

[21] Appl. No.: 276,098

[22] Filed: Jun. 22, 1981

[51] Int. Cl.[3] ..... B32B 5/16

[52] U.S. Cl. ..... 428/240; 264/22; 264/69; 264/184; 428/244; 428/283; 428/297; 428/372

[58] Field of Search ..... 428/244, 240, 281, 283, 428/297, 367, 368, 372, 371; 264/22, 23, 69, 184, 236

[56] References Cited

U.S. PATENT DOCUMENTS

| | | | |
|---|---|---|---|
| 3,732,652 | 5/1973 | Furgal et al. | 5/401 |
| 3,971,373 | 7/1976 | Braun | 428/328 |
| 4,127,624 | 11/1978 | Keller et al. | 264/23 |
| 4,221,697 | 9/1980 | Osborn et al. | 428/331 |
| 4,296,166 | 10/1981 | Ogino | 428/283 |
| 4,342,811 | 8/1982 | Lopatin et al. | 428/315.5 |

*Primary Examiner*—William J. Van Balen

*Attorney, Agent, or Firm*—W. J. Bethurum; A. W. Karambelas

[57] ABSTRACT

Composites, comprising organic polymeric fibers and solid particles, are described which exhibit a wide range of functional characteristics. The materials are light in weight, structurally strong and are air permeable. The fabrication of protective clothing for use in chemical warfare environments is a typical use for which these composites are suitable.

27 Claims, 3 Drawing Figures

MULTI-PURPOSE AIR PERMEABLE COMPOSITES

TECHNICAL FIELD

This invention relates, generally, to the provision of solid-solid composites used as structural materials and more particularly to the preparation of composites having organic fibers and solid particles.

BACKGROUND OF THE INVENTION

1. Field of the Invention

This invention provides new composites, which can be used in the preparation of fabrics for protective clothing, filters, structural preforms, and membranes. These composites exhibit a wide variety of functional characteristics.

2. Description of the Prior Art

Synthetic fabrics, both woven and non-woven, are well known and have been used in countless applications for some time. Many of these fabrics may be characterized as composites in that they are comprised of two or more distinctively different materials that are bound together in some manner to provide a single material whose properties differ from that of either of its constituent elements. Typical applications for these fabrics or composites include, but are not limited to, the fabrication of protective clothing, filters, screens, protective shields, and numerous decorative items.

Of particular interest in this art and to the present inventors is the use of fabrics and/or composites in the fabrication of chemically absorptive clothing. Currently, protective clothing for certain chemical environments utilize polyurethane foam laminated to a tricot-knit nylon cloth and then impregnated with activated charcoal. A latex compound is used to bind the charcoal to the foam, and mechanical strength is provided by the nylon. There are, however, several drawbacks to this prior art material which originate with the foam portion of the laminate. First, the processing required to fabricate the laminate is expensive and complicated. Second, some of the properties of the final material do not fit the above application. The foam is flammable and it has low thermal conductivity resulting in large heat loads on the wearer. The low permeability of foam to water vapor accentuates the latter problem. Third, because of reversion of the polyurethane, the material has limited shelf life. Finally, the necessity of using a latex compound to bind the charcoal to the foam, or some other resin as a binder for the solid particles, further lessens the utility of prior art composites having solid particles. Resin or latex matrices are generally impermeable to moisture as well as to air and tend to coat the surfaces of the active particles as well as binding them to the fabric.

Consequently, there is still a need to provide materials of the type generally described above of equal or better chemical absorptivity than the current materials while achieving higher moisture permeability, lower heat loads, lighter weight, and greatly extended shelf life. It is the fulfillment of this need to which the present invention is directed. However, the techniques developed are suitable for many other applications and are not limited to absorbent protective clothing.

SUMMARY OF THE INVENTION

The general purpose of this invention is to provide an air-permeable fabric or composite exhibiting selected functional characteristics, such as chemical absorptivity, which at the same time are moisture-permeable, have low heat loads, are light weight, structurally strong and have exhibited extended shelf life. In achieving this purpose, we have discovered a new class of tailorable composites which are air-permeable. These composites are fabricated using solid particles or short staple fibers which are interstitially positioned within a three-dimensional web-like network of organic fibers which coil about and entrap, without coating, said particles, and are intertwined to form a stable solid-in-solid suspension that is structurally strong, porous and light in weight.

Different functional characteristics can be imparted to the composites of this invention by a proper selection of the solid particles. For example, porous absorptive particles are used to impart chemical absorptivity to the composites, while moisture absorptive particles are utilized to impart drying characteristics to the resulting composite, and metallic particles may be utilized to impart shielding characteristics to the fabric or composite. Alternatively, short staple fibers, such as glass or graphite, may be suspended in the organic fiber network to form isotropically reinforced preforms useful in the manufacture of reinforced plastic articles.

The composites of this invention are prepared by first providing a hot polymer solution of a fiber-forming polymer material and subsequently adding thereto the desired class of solid particles to form a suspension of solid particles in the polymer solution. The temperature of the solution is lowered while agitation is applied. This action causes the polymer to form fibers from the solution which encircle, coil about, and entrap the solid particles within a fibrous network without coating the particles as the fibers precipitate from the solution.

It is therefore one purpose of this invention to provide a chemically absorptive fabric or composite suitable for use in the fabrication of protective clothing.

A second purpose of this invention is to provide tailorable composites which are air-permeable and can be adapted for a multiplicity of uses.

A still further purpose of this invention is to provide an air-permeable fabric that is light in weight, moisture-permeable, and chemically absorptive.

A still further purpose of this invention is to provide structurally sound composites which exhibit all of the advantages of prior art composites used for absorptive clothing and which exhibit few, if any, of the disadvantages of said prior art fabrics. A particular advantage and novel feature of this invention is the provision of a composite of the type described and a process for fabricating the same which completely eliminates the prior art requirement that a resin of some sort be included in the particulate solution in order to provide a bonding agent between the fibers and the particles adjacent thereto.

That we have substantially accomplished the above-stated purposes and accomplished other objectives, will become clear upon reference to the following detailed description of the invention.

DETAILED DESCRIPTION OF THE INVENTION

Figure 1:
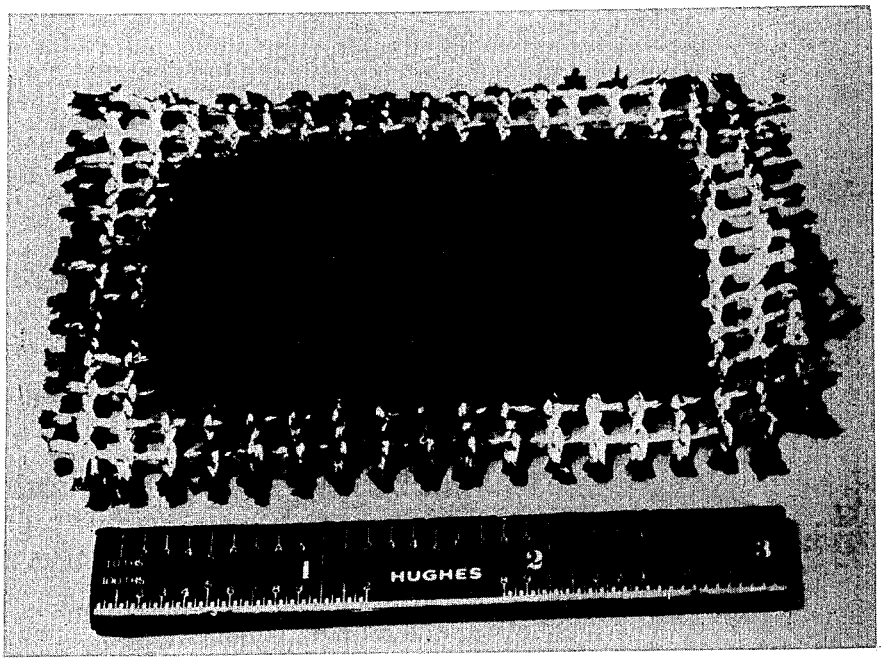
FIG. 1 is a photograph of an open weave cloth fiberized with polypropylene and activated charcoal, prepared in accordance with the invention.

In seeking to provide an improved fabric for use in the fabrication of chemically absorptive clothing, which exhibits few, if any, of the disadvantages of prior art fabrics used for their above selected purposes, we discovered that air permeable composites could be prepared from organic fibers, in combination with solid particles and short fibers, thereby providing fabrics and fibrous preforms suitable for use in numerous applications as well as in the fabrication of chemically absorptive clothing. We refer to our composites as "tailorable composites" because it is possible to "tailor" the composites to fit numerous applications by properly selecting the type of solid particles and the organic fibers to be utilized.

Generally, to practice the invention, a polymer-solvent solution is prepared by dissolving an organic polymer in a suitable solvent at an elevated temperature. Selected solid particles are then added to the solution and mixed to form a particle suspension in the polymer-solvent solution at the elevated temperature. Upon, or after cooling, constant agitation causes polymeric fibers to form, coil around the suspended solid particles, and precipitate from the solution thereby pulling the solid particles out of suspension. The final product, after removal of the original solvent, is a fibrous web-like network of intertwined fibers coiled around solid particles which are entrapped within the interstices of said network.

Numerous types of composites may be prepared via the above-stated general description as long as solid particles are selected which are not soluble in, or reactive to, the selected solvent, and so long as the solid particles are not so large or dense that they cannot be maintained in a uniform suspension during the organic fiber formation process. Particles having mean diameters ranging from $5\times10^2$ Å to $1\times10^7$ Å, depending upon their densities, have been utilized. Small or larger particles may be used so long as the particles are suspendable in the solvent. A polymer or polymer mixture must be selected which forms fibers upon solution agitation.

Composites may be tailored to provide fabrics having numerous functional characteristics by selecting solid particles which exhibit various functional characteristics and by selecting a fiber forming polymer which exhibits a desired set of properties. For example: in preparing chemically absorptive fabrics, as originally intended, chemically absorptive porous particles such as activated charcoal, activated alumina, fuller's earth, and diatomaceous earth may be used with polypropylene or other aliphatic partially crystalline polymers; if one wanted to tailor a fabric to absorb moisture, solid particle drying agents such as silica gel, calcium sulfate and magnesium sulfate may be selected; to prepare a fabric having fire-retardant properties, the phosphates, borates and arsenates of calcium and/or sodium may be selected; solid coloring agents such as iron oxide, mercuric chromate, lead chromate and phthalocyanine dyes may be selected to prepare air-permeable fabrics having selected color characteristics; and other solid fibers having distinctive characteristics, such as chopped glass fibers, asbestos fibers, graphite fibers, and metal powders may be used with selected fiber forming polymers.

We prefer to form our composites by precipitating the fibers from supercooled solutions, containing the suspended particles, with oscillatory agitation as described in U.S. Pat. No. 4,127,624, issued to Leon B. Keller et al. on Nov. 28, 1978, the teaching of which we incorporate herein by reference. However, other forms of mechanical perturbations such as stirring may also be utilized. Generally, we use the process described in the'624 Keller Patent.

Ocillatory agitation at frequencies in the range of 100 Hz appear to yield the best results, with frequencies below 100 Hz being optimum. However, fiberization of the polymer does occur at frequencies up to 20,000 Hz with acceptable kinetics and resulting morphology. No appreciable fiberization was found to occur at ultrasonic frequencies (>20,000 Hz).

In some instances, such as where non-crystalline polymers are selected, it is necessary to add an isotactic crystalline seeding polymer to the non-crystalline polymer-solvent solution to cause fibers to be produced from the solution. In fact, the use of a seeding polymer enhances the production of fibers from crystalline polymer solutions as well; although such seeding is not necessarily required with crystalline polymers.

Polymers which are highly suitable for this invention are the linear, crystalline, polyalkenes such as the series including polyethylene, polypropylene, polybutene, poly(4-methyl-1-pentene) and so forth. Also, polymers such as polyvinylidene fluoride, and polychlorotrifluoroethylene may be used. Modified versions of the aforementioned polymers may also be used such as propylene-acrylic acid copolymers. Fiber networks may also be formed from many other polymers, such as: nylon, polystyrene, polyethylene oxide, polyacrylonitrile, acrylonitrile-butadiene-styrene terpolymers, and tetrafluoroethylene-hexafluoropropylene-vinylidene terpolymers when precipitated in a fiber network in combination with a suitable seeding polymer typically selected from the linear, crystalline polyalkenes.

A primary processing solvent whose boiling point is moderately high, such as mixed xylenes, styrene or decalin, should be selected from compatibility with the polymer selected to form the fibrous mass. After cooling to ambient temperatures, the primary solvent is removed from the precipitated fibrous mass by extracting in a low boiling solvent such as pentane, methanol, or acetone followed by a drying step.

Processing in organic solvents eliminates, or reduces, the activity of activated charcoal. However, the activity of the charcoal is regenerated after solvent removal by subsequent vacuum baking at temperatures on the order of 120° C. from 1 to 24 hours.

We have made polypropylene/charcoal composites from polymer-solvent solutions containing from 0.5 to 7.0% polypropylene (weight to volume) and 0.5 to 4.0% activated charcoal (weight to volume).

It is also possible to utilize more than one type of solid particle to obtain a fabric exhibiting a desired combination of functional characteristics. For example: a coloring agent may be utilized with activated charcoal to impart color to the fabric; and calcium phosphate may be utilized with activated charcoal to provide a chemically absorptive fabric that is also flame-resistant. The number of combinations made possible by the invention are virtually unlimited.

The following examples are provided to further illustrate this invention.

EXAMPLE 1

A seven percent solution of isotactic polypropylene in xylene containing suspended charcoal powder (Ball milled Calgon PCB-D sold by Calgon Corporation of Pittsburgh, PA) was placed in a test tube, capped, and agitated while being cooled from 100° C. (212° F.) to room temperature. The tube was shaken unidirectionally at a frequency which varied from 1000 to 40 Hz, and at an amplitude of from approximately 0.1 to 0.5 inches. After agitation, the fibrous specimen, which appeared upon cooling, was extracted with acetone and dried. The product was a three-dimensional fibrous mass which conformed to the shape of the container in which it was made. The activated charcoal was uniformly distributed throughout the porous mass.

Carbon tetrachloride ($CCl_4$) absorption tests were performed on samples prepared in this manner. The specimens were baked under vacuum to remove residual solvent left over from processing, and then placed in open weighing dishes. These specimens were weighed and then placed in closed desiccators containing liquid $CCl_4$; the samples were suspended above the fluid and not submerged in it. After 24 hours the dishes were removed from the desiccators and reweighed to determine the amount of gaseous $CCl_4$ absorbed by the specimens. Control experiments using weighing dishes partially filled with pure charcoal powder which had been subjected to the same vacuum baking treatment were run simultaneously. The results are shown in the following Table.

TABLE I $CCl_4$ Vapor Absorption of Pure Calgon PCB Activated Charcoal and Fiber Plugs Containing Calgon PCB

| Specimen | History | Test No. | mg $CCl_4$ absorbed/mg charcoal after 24 hrs in $CCl_4$ vapor |
|---|---|---|---|
| Calgon PCB | Ball milled and vacuum baked 24 hrs - 120° C. | 1 | .535 |
| | | 2 | .446 |
| Polypropylene (PP) Fiber Plugs, Containing 33 Percent Charcoal by Weight | Vacuum baked 24 hrs - 120° C. | 1 | .224 |
| | | 2 | .224 |

As shown in Table I, the charcoal in the fiber samples has an apparent activity of nearly half that of the control charcoal (pure polypropylene samples retain essentially zero weight gain). The last activity is assumed to be due to partial masking of the charcoal by the polypropylene as well as perhaps some residual solvent left over from incomplete pre-test baking.

EXAMPLE 2

Another type of specimen was prepared by agitating and cooling a similarly prepared solution in a metal can by use of a commercial paint shaker. The fiber/powder mass which resulted was chopped in a blender, cast into a mat form, extracted with acetone and dried. This product exhibited felt-like characteristics with charcoal particles uniformly distributed throughout the sheet of the material.

EXAMPLE 3

Figure 2:
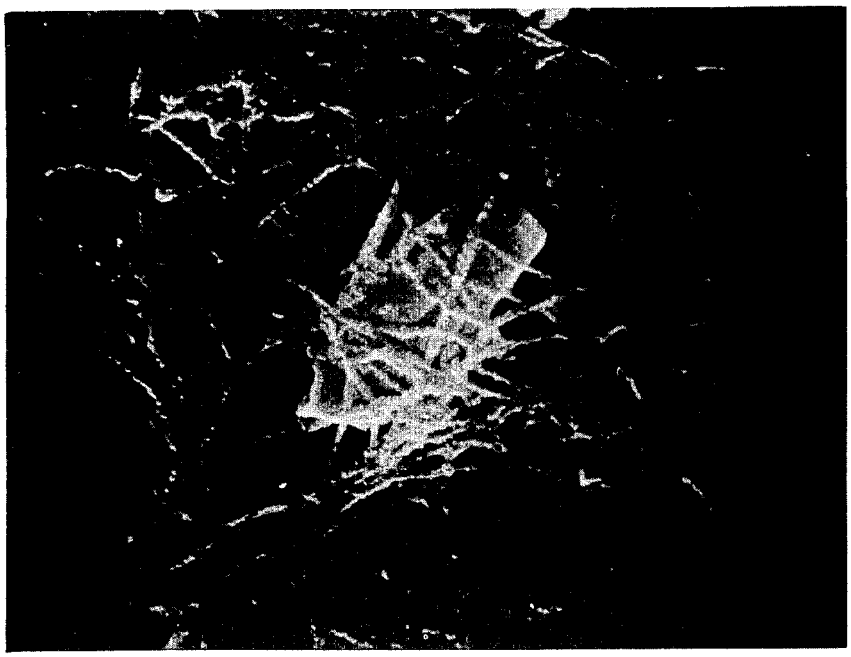
FIG. 2 is a scanning electron micrograph, taken at 4,700×, of another specimen similarly prepared.
Figure 3:
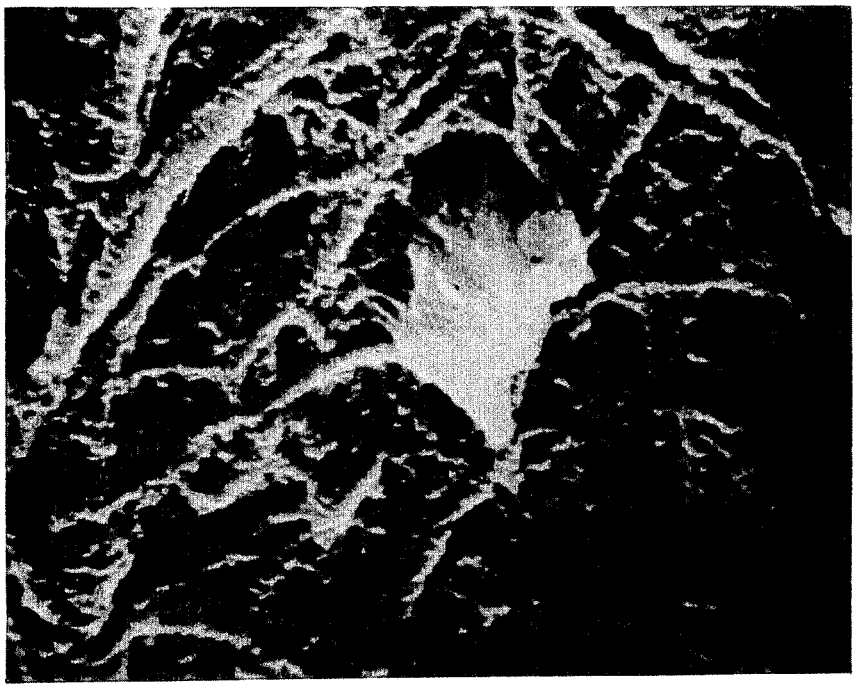
FIG. 3 is also a scanning electron micrograph, taken at 10,200×, of another specimen similarly prepared.

A third type of fiber/charcoal composite was prepared by agitation of a piece of open weave cloth in a stationary mixed xylenes solution containing 2% isotactic polypropylene and suspended charcoal powder. The solution was cooled to 95° C. and agitation was conducted isothermally at 95° C. at a frequency of 40 Hz and with a peak-to-peak linear displacement of approximately one-half inch. The resultant composite is shown at close to actual size in FIG. 1. FIG. 1 is a photograph of an open weave cloth fiberized with polypropylene and activated charcoal. FIGS. 2 and 3 show high magnification, 4,700× and 10,200× respectively, scanning electron micrographs of other specimens prepared in a similar manner. It is clear from the latter that the powder particles are physically entrapped in the fiber network.

$CCl_4$ absorption experiments were performed as above to determine the degree of absorption of specimens like that of FIGS. 1–3. The data are shown in Table II. For these experiments, the initial weight of activated charcoal in the fiberized specimens could not be readily obtained. Therefore, results are expressed in terms of weight absorbed per square centimeter of sample. The results indicate an equivalent loading of over 30 mg activated charcoal per square centimeter (obtained by dividing mg $CCl_4/cm^2$ by mg $CCl_4$/mg pure charcoal). This is greater than an order of magnitude more than is required of present materials for military chemical warfare protective clothing applications.

TABLE II $CCl_4$ Vapor Absorption of Polypropylene/Charcoal/Open Mesh Cloth Samples

| Specimen | History | Test No. | After 24 hours in $CCl_4$ Vapor |
|---|---|---|---|
| | | | mg $CCl_4$ absorbed/mg charcoal |
| Calgon PCB | Ball milled and baked 48 hours at 125° C. | 1 | .54 |
| | | | mg/$CCl_4$/sq cm cloth |
| Open Mesh Cloth, Fiberized in 2% PP, 1% Suspended Charcoal in Xylenes | Vacuum baked 48 hours at 125° C. | 1 | 23 |
| | | 2 | 20 |

EXAMPLE 4

To a 5% by weight solution of isotactic polypropylene in xylenes was added 5% by weight of milled glass fibers. The fibers were type E glass and were milled to lengths of 0.025 inch or less. The diameter of these fibers is approximately 0.0003 inch. The hot solution was placed in a test tube and vigorously agitated at varying frequencies in the range from 80 to 200 Hz. As the solution cooled to about 95° C. a fibrous mass was formed. This fibrous mass or plug was cooled, extracted with fresh xylene, washed with ethanol and dried. The resulting fibrous mass contained uniformly dispersed short glass fibers which were randomly oriented in three directions. The fibrous mass was subsequently impregnated with a low viscosity epoxy resin and cured to form a solid fiber reinforced composite.

EXAMPLE 5

To a 2% by weight solution of isotactic polypropylene in xylenes was added ≈0.1% by weight chopped graphite fibers (Celion 3000) and ½% by weight powdered lead oxide. This solution was stirred in a flask by means of a metal screen, connected to a metal rod immersed in the solution. Upon cooling below 95° C., a fibrous mass formed on the screen. This was removed from the solution, cooled, solvent extracted with acetone, and dried. The resultant fiber mass contained the chopped graphite fiber and the yellow lead oxide powder entrapped in the polypropylene fiber network.

INDUSTRIAL APPLICABILITY

This invention facilitates the design and fabrication of a wide variety of cloths and/or fabrics which exhibit functional characteristics tailored to solve numerous design requirements. Composite fabrics prepared in accordance with the invention where activated charcoal powders or particles are utilized are suitable for use in the fabrication of protective clothing as, for example, chemical warfare garments.

Having completely described our invention, and having provided teachings to enable others to make and utilize the same, the scope of our claims may now be understood as follows.

What is claimed is:

1. A tailorable air permeable composite, suitable for use in the fabrication of protective clothing, filters and other structural membranes comprising selected solid particles interstitially located within a web-like network of interconnected, branched organic fibers wherein said fibers are formed from solution in the presence of said particles and coil about and entrap said particles in situ during the formation of said fibers, without coating said particles, thereby forming a stable solid-in-solid suspension that is structurally strong, porous and light in weight.

2. A composite of claim 1 wherein the mean diameter of said particles is greater than the mean diameter of said fibers.

3. A composite of claim 1 wherein said network is comprised of fibers whose diameters range from $5\times10^2$ Å to about $1\times10^7$ Å, and wherein said entrapped particles have diameters larger than said entrapping fibers.

4. A composite of claim 1 wherein said fibers are selected from the group of polyethylene, polypropylene, polybutene, poly-4-methyl-1-pentene, polystyrene, polyethylene oxide, nylon, poly(4-methylpentene-1), propylene-acrylic acid copolymers, acrylonitrile-butadiene-styrene terpolymers, blends of polyvinylidene and tetrafluoroethylene-hexafluoropropylene-vinylidene terpolymers and mixtures of the above.

5. A composite of claim 1 wherein said solid particles are porous absorptive particles selected from the group consisting of activated charcoal, silica gel, activated alumina, diatomaceous earth, and fuller's earth.

6. A composite of claim 1 wherein said solid particles are activated charcoal and said fibers are polypropylene fibers.

7. A tailorable air permeable composite comprising solid microscopic particles interstitially positioned within a web-like network of submicroscopic interconnected, branched organic fibers wherein said fibers as formed coil about said particles thereby entrapping said particles, and intertwine with each other, to form a stable structurally strong lightweight porous material.

8. A composite in accordance with claim 7 wherein said particles are selected from the group consisting of coloring agents, fire-retardant agents, absorptive agents, magnetic agents, conductive agents, and drying agents to thereby impart the functional characteristics of said agents to said composite while maintaining air permeability.

9. A composite in accordance with claim 8 wherein said fibers are selected from the group consisting of polyethylene, polypropylene, polybutene, polypentene, polystyrene, polyethylene oxide, nylon, poly(4-methylpentene-1), propylene-acrylic acid copolymers, acrylonitrile-butadiene-styrene terpolymers, blends of polyvinylidene and tetrafluoroethylene-hexafluoropropylene-vinylidene terpolymers and mixtures of the above.

10. A composite in accordance with claims 8 or 9 wherein said particles are activated charcoal particles and said network is a three-dimensional interconnected mass of organic fibers.

11. A composite of claim 10 wherein said mass of organic fibers are polypropylene fibers.

12. An air permeable absorptive fabric for use in the fabrication of protective clothing prepared by the process of:

providing a polymer-solvent solution by dissolving a selected fiber forming polymer, or mixture of polymers, in an organic processing solvent at an elevated temperature;

adding absorptive solid particles to said solution and mixing said particles with said solution to form a suspension of said particles in said solution;

applying constant agitation to said suspension while lowering its temperature to cause fibers to be formed from said solution-suspension which encircle, coil around and entrap said solid particles as they precipitate from said solution into a three-dimensional web-like fibrous mass; and subsequently removing traces of said processing solvent by extracting said solvent with a low boiling solvent and vacuum baking said fibrous mass, thereby providing a solid-in-solid composite fabric that is chemically absorptive.

13. A fabric prepared in accordance with claim 12 wherein said absorptive particles are activated charcoal particles and said fiber forming polymer is selected from the group consisting of polypropylene, polyethylene, polypropylene oxide, polystyrene and nylon.

14. A fabric of claim 13 wherein said polymer is polypropylene.

15. A process for preparing multi-purpose air permeable composites comprising the steps of:

forming a solvent-suspension of selected solid particles in a fiber forming polymer-solvent solution at an elevated temperature;

applying constant agitation to said suspension while lowering the temperature of said suspension thereby causing polymeric fibers to form, encircle, coil about said particles, and entrap said particles while said particles are coprecipitated from said solvent suspension with said fibers; and subsequently extracting said solvent from said coprecipitated particles and fibers to thereby yield a three-dimensional web-like network of polymeric fibers having solid particles permanently entrapped within the interstices of said network that exhibits functional characteristics commensurate in scope to the functional characteristics of said solid particles.

16. A process of claim 15 wherein the mean diameter of said solid particles is larger than the mean diameter of the fibers formed from said solution.

17. A process of claim 15 wherein said agitation is an oscillatory agitation at frequencies less than 20,000 Hz.

18. A process for forming a fiber-solid particle mass composite having improved air permeability and structural characteristics which comprises:

(a) providing a fiber forming solution;

(b) suspending selected solid particles in said solution characterized in that the mean diameter of said particles is greater than the mean diameter of fibers which form from said solution; and (c) treating said solution in a manner sufficient to cause fibers to precipitate therefrom and simultaneously entrap said particles thereby removing said particles from said solution to form a three-dimensional fiber-solid particle mass which retains its structural integrity without the aid of a resin or other particle-to-fiber bonding agent.

19. A process of claim 18 wherein said solid particles are short fibers.

20. A process of claim 19 wherein said solid particles are short milled glass fibers and said process further includes impregnating said fiber-solid particle mass with an epoxy resin and curing said resin to form a solid fiber reinforced composite.

21. A process of claim 18 wherein additionally a support member is placed in said solution and said fiber-solid particle mass forms on the surfaces of said support member.

22. A process of claim 18 wherein said solid particles comprise chopped graphite fibers and lead oxide powder.

23. A process for preparing an air permeable composite fiberized cloth comprising the steps of:

providing a piece of open weave cloth;

forming a solvent-suspension of selected solid particles in a fiber forming polymer-solvent solution at an elevated temperature;

immersing said cloth in said solvent-suspension;

applying constant agitation to said cloth to provide constant agitation to said suspension while lowering the temperature of said suspension thereby causing polymeric fibers to form, encircle, coil about said particles, and entrap said particles while said particles are coprecipitated from said solvent-suspension with said fibers on said open weave cloth and into the open spaces thereof; and subsequently extracting said solvent from said coprecipitated particles and fibers and said cloth to thereby yield a fiberized cloth comprising a three-dimensional web-like network of polymeric fibers having solid particles permanently entrapped within the interstices of said network, wherein said fiberized cloth exhibits functional characteristics commensurate in scope with the functional characteristics of said solid particles.

24. A composite as set forth in claim 1 which additionally includes an open weave cloth substrate wherein said fibers entrapping said particles are formed in the presence of said substrate and deposit on said substrate and in the open spaces thereof.

25. A composite as set forth in claim 1 wherein said solid particles are short fibers.

26. A fabric prepared in accordance with claim 12 wherein the process further includes, prior to said removing traces of said processing solvent, chopping said fibrous mass to form chopped fibrous particles and casting said chopped fibrous particles into a mat form, wherein said composite fabric exhibits felt-like characteristics.

27. An air permeable absorptive fabric for use in the fabrication of protective clothing prepared by the process of:

providing a piece of open weave cloth;

providing a polymer solvent solution by dissolving a selected fiber forming polymer, or mixture of polymers, in an organic processing solvent at an elevated temperature;

adding absorptive solid particles to said solution;

immersing said cloth in said solution containing said particles and agitating said cloth to mix said particles with said solution to form a suspension of said particles in said solution;

applying constant agitation to said cloth to provide constant agitation to said suspension while lowering the temperature of said suspension to cause fibers to be formed from said solution-suspension which encircle, coil around and entrap said solid particles as they precipitate from said solution onto said open weave cloth to form a fiberized open weave cloth; and subsequently removing traces of said processing solvent by extracting said solvent with a low boiling solvent and vacuum baking said fiberized open weave cloth, thereby providing a solid-in-solid composite fabric that is chemically absorptive and comprises said open weave cloth fiberized with said polymer and said solid particles entrapped therein.

* * * * *